US011480095B2

(12) United States Patent
Girondi

(10) Patent No.: US 11,480,095 B2
(45) Date of Patent: Oct. 25, 2022

(54) OIL TEMPERATURE CONTROL ASSEMBLY

(71) Applicant: UFI FILTERS S.P.A., Mantova (IT)

(72) Inventor: Giorgio Girondi, Mantova (IT)

(73) Assignee: UFI FILTERS S.P.A., Mantova (IT)

( * ) Notice: Subject to any disclaimer, the term of this patent is extended or adjusted under 35 U.S.C. 154(b) by 0 days.

(21) Appl. No.: 16/970,240

(22) PCT Filed: Feb. 25, 2019

(86) PCT No.: PCT/IB2019/051499
§ 371 (c)(1),
(2) Date: Aug. 14, 2020

(87) PCT Pub. No.: WO2019/166933
PCT Pub. Date: Sep. 6, 2019

(65) Prior Publication Data

US 2020/0408135 A1 Dec. 31, 2020

(30) Foreign Application Priority Data

Feb. 28, 2018 (IT) ..... 102018000003132

(51) Int. Cl.
*F28F 27/02* (2006.01)
*F28F 3/08* (2006.01)
(Continued)

(52) U.S. Cl.
CPC ..... *F01P 11/08* (2013.01); *F01M 5/002* (2013.01); *F01M 5/007* (2013.01); *F28D 9/005* (2013.01);
(Continued)

(58) Field of Classification Search
CPC ..... F28F 27/02; F28F 2250/06; F28F 27/00; F28F 3/086; F28F 9/0075; F28F 3/08;
(Continued)

(56) References Cited

U.S. PATENT DOCUMENTS

2013/0133874 A1 5/2013 Kim et al.
2013/0160972 A1* 6/2013 Sheppard ..... F28F 27/02 165/96
(Continued)

FOREIGN PATENT DOCUMENTS

EP 2 327 862 A1 6/2001
WO 2004/092552 A2 10/2004
WO 2013/091108 A1 6/2013

OTHER PUBLICATIONS

International Search Report and Written Opinion of the International Searching Authority for International Patent Application No. PCT/IB2019/051499 dated May 29, 2019, 12 pages.

*Primary Examiner* — Long T Tran
(74) *Attorney, Agent, or Firm* — Merchant & Gould P.C.

(57) ABSTRACT

An oil temperature control assembly mounts on a vehicle's operating group fluidically connected to an oil circulation system and a cooling system. A heat exchanger has plate-shaped exchanger elements defining reciprocally alternate ducts through which oil and refrigerant fluid flow, and a support and oil control device. The support and oil control device has a plate-shaped base element including the oil inlet and outlet ducts having a first surface in contact and engageable by the heat exchanger and a second opposite surface. The support and oil control device includes a control group having a housing body projecting from the first surface next to the heat exchanger having a housing cavity fluidically connected to the inlet and outlet ducts and an exchanger duct and a valve member in the housing cavity including an obturator element and a control element which moves the obturator element according to oil operating conditions.

20 Claims, 13 Drawing Sheets

(51) Int. Cl.

| | |
|---|---|
| ***F28D 9/00*** | (2006.01) |
| ***F01P 11/08*** | (2006.01) |
| ***F01M 5/00*** | (2006.01) |
| *F01P 11/04* | (2006.01) |
| *F28D 21/00* | (2006.01) |

(52) U.S. Cl.
CPC ..... *F28F 27/02* (2013.01); *F01P 11/04* (2013.01); *F28D 2021/0089* (2013.01); *F28F 2250/06* (2013.01); *F28F 2280/06* (2013.01)

(58) Field of Classification Search
CPC ..... F28D 2021/0089; F28D 9/005; F28D 9/0037; F28D 2021/0049; F28D 15/00; F28D 15/0275
See application file for complete search history.

(56) References Cited

U.S. PATENT DOCUMENTS

| | | | | |
|---|---|---|---|---|
| 2013/0319634 | A1* | 12/2013 | Sheppard | F28F 27/02 165/96 |
| 2015/0316331 | A1 | 11/2015 | Kim et al. | |
| 2016/0363399 | A1* | 12/2016 | Kim | F28D 9/005 |
| 2018/0010866 | A1* | 1/2018 | Sheppard | F16K 31/002 |
| 2018/0274406 | A1* | 9/2018 | Dries | F01M 5/007 |

* cited by examiner

FIG.3"

OIL TEMPERATURE CONTROL ASSEMBLY

This application is a National Stage Application of PCT/M2019/051499, filed 25 Feb. 2019, which claims benefit of Patent Application Serial No. 102018000003132, filed 28 Feb. 2018 in Italy and which applications are incorporated herein by reference. To the extent appropriate, a claim of priority is made to each of the above-disclosed applications.

FIELD OF APPLICATION

The present invention relates to an oil temperature control assembly.

In particular, the present invention lies within the automotive sector.

The oil temperature control assembly of the present invention in fact finds specific application in a vehicle, for example to control the temperature of the oil circulating in an oil circulation system of said vehicle. More in detail, the oil temperature control assembly is mounted on an operating group of a vehicle to be fluidically connected with the oil circulation system of said operating group.

In particular, the term operating group is understood to refer to a component or group of components which an oil circulation system is present in, such as an engine group and/or a transmission group.

In addition, the oil temperature control assembly of the present invention is also fluidically connectable to a water system of the vehicle, or in general to a cooling system.

STATE OF THE ART

Oil temperature control assemblies are known of in the prior art which are connectable to an oil circulation system and comprise a plate heat exchanger suitable for performing control operations of the oil temperature in turn connected to a cooling system in which refrigerant liquid circulates, e.g. water or water-based.

Oil temperature control assemblies are also known of which have specific bypass components suitable to prevent, as a function of certain characteristics of the oil such as for example pressure and viscosity, the flowing thereof into the heat exchanger group.

Such solutions however have particularly complex geometries and layouts.

In particular, the prior solutions have complex layouts of the various ducts through which the oil flows to the heat exchanger. In particular, these layouts are even more complex when within them they comprise specific control members of the passage of liquid.

In the solutions of the prior art, the increased complexity of said layouts corresponds to higher production and realisation costs.

In addition, in the solutions of the prior art, the greater complexity of said layouts corresponds to specific difficulties in positioning the oil temperature control assembly inside the vehicle: in the automotive sector, moreover, the need to occupy as little space as possible is still particularly felt.

For example, some embodiments of oil temperature control assemblies of the prior art having these drawbacks are described in the document US2013/0319634.

Solution According to the Invention

The need is therefore strongly felt to provide an oil temperature control assembly which solves the aforementioned problems.

The purpose of the present invention is to provide an oil temperature control assembly which performs the temperature control operations in an effective manner and with a geometry and layout of the ducts as simple as possible.

DESCRIPTION OF THE DRAWINGS

Further characteristics and advantages of the invention will, in any case, be evident from the description given below of its preferred embodiments, made by way of a non-limiting example with reference to the appended drawings, wherein.

DETAILED DESCRIPTION

Figure 1:
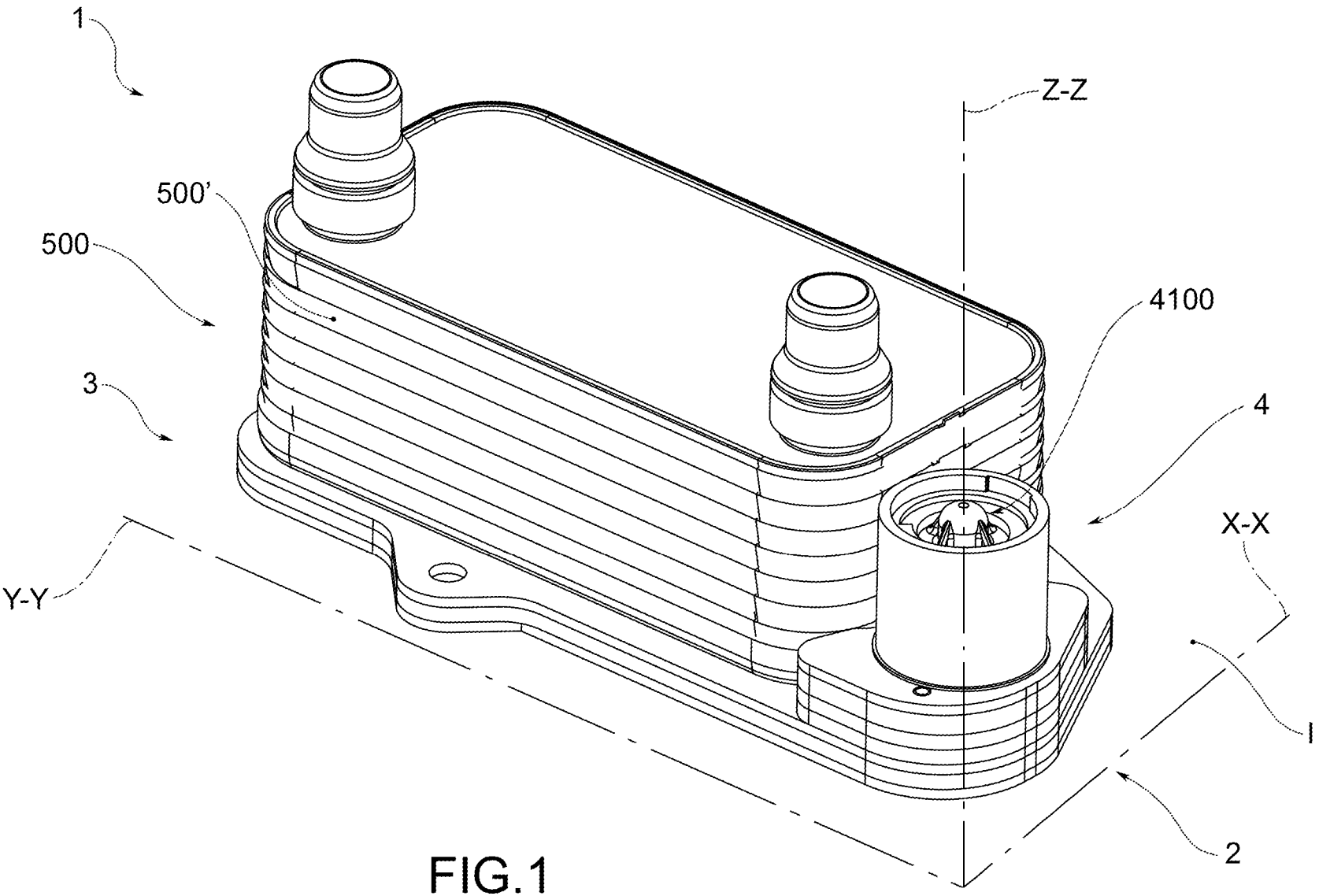
FIG. 1 shows a perspective view of the oil temperature control assembly of the present invention, according to a first preferred embodiment.
Figure 1A:
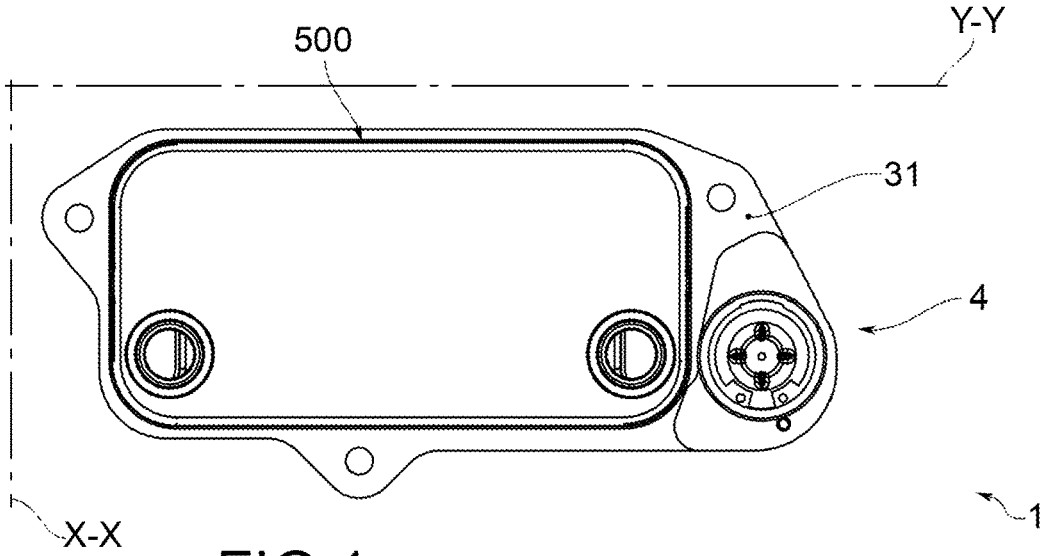
FIGS. 1*a*, 1*b* and 1*c* show three perspective views from the top, side, and bottom of the oil temperature control assembly shown in FIG. 1.
Figure 1B:
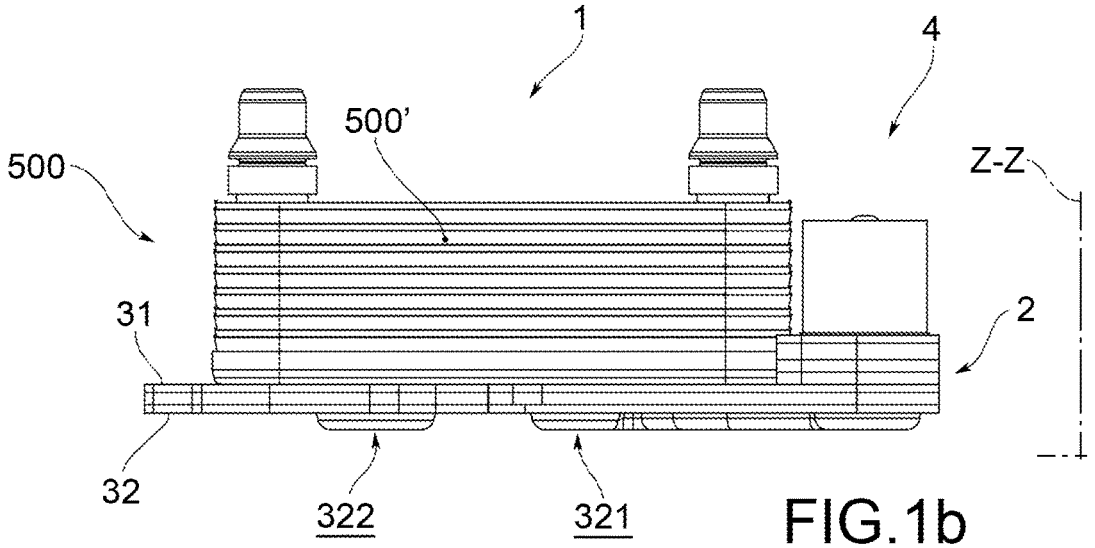
Figure 1C:
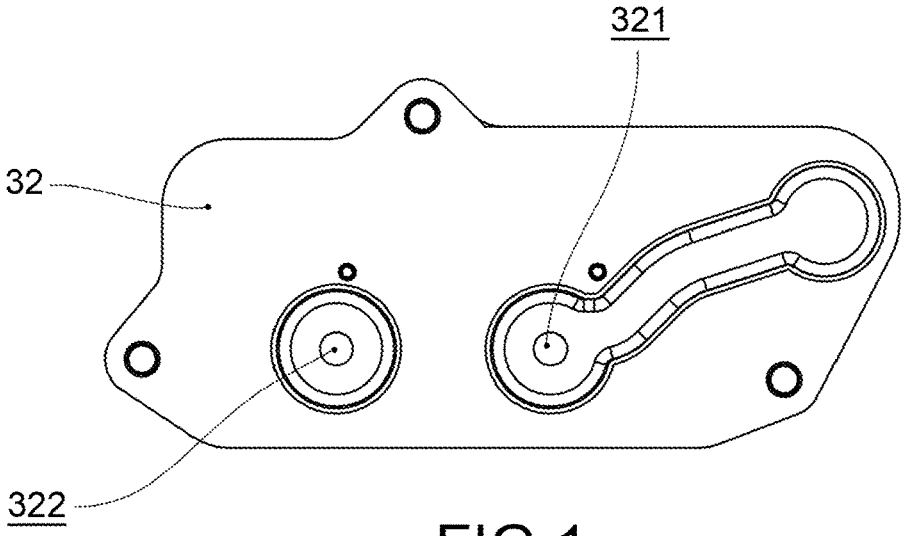
Figure 2:
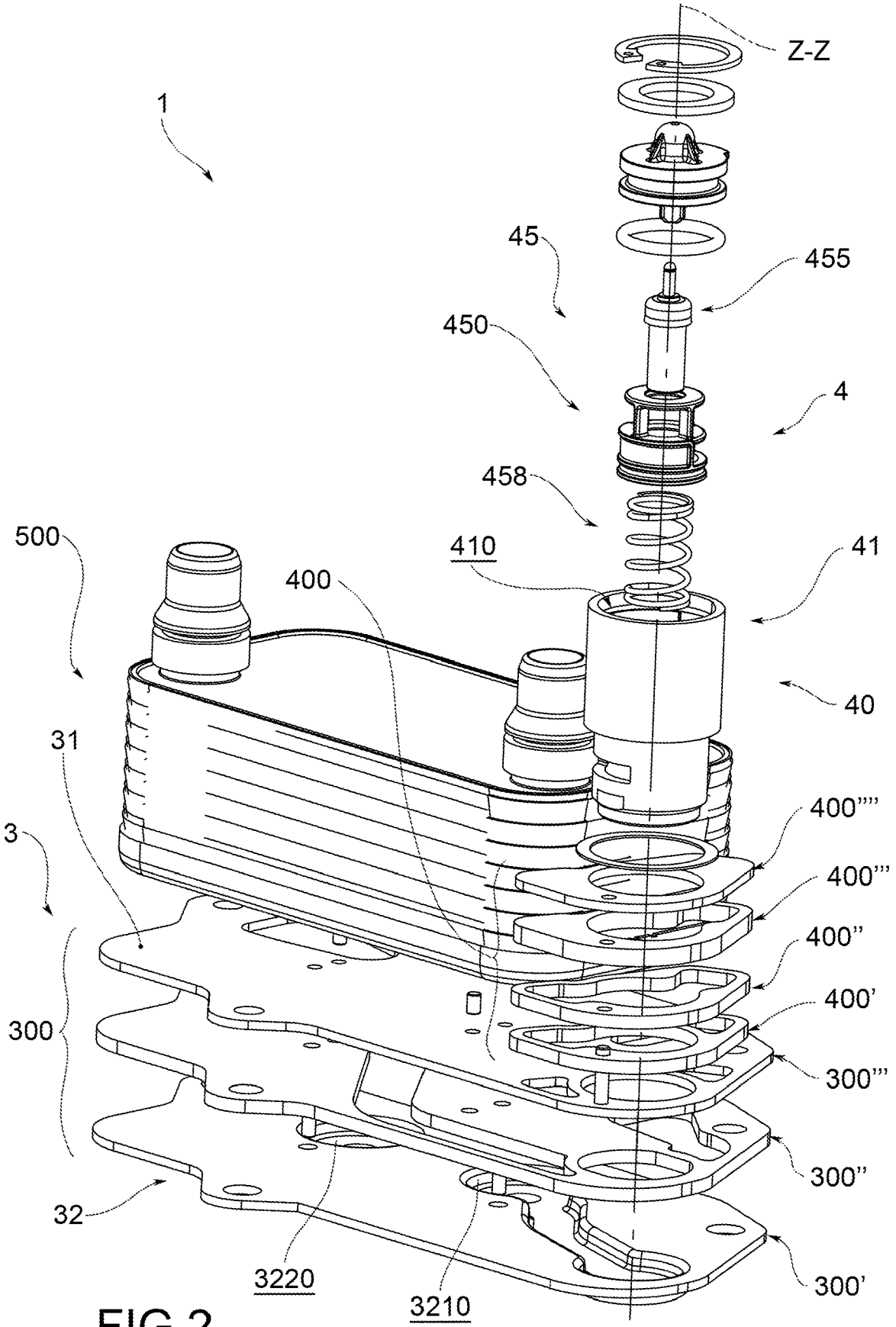
FIG. 2 shows a perspective view in separate parts of the oil temperature control assembly shown in FIG. 1.
Figure 3:
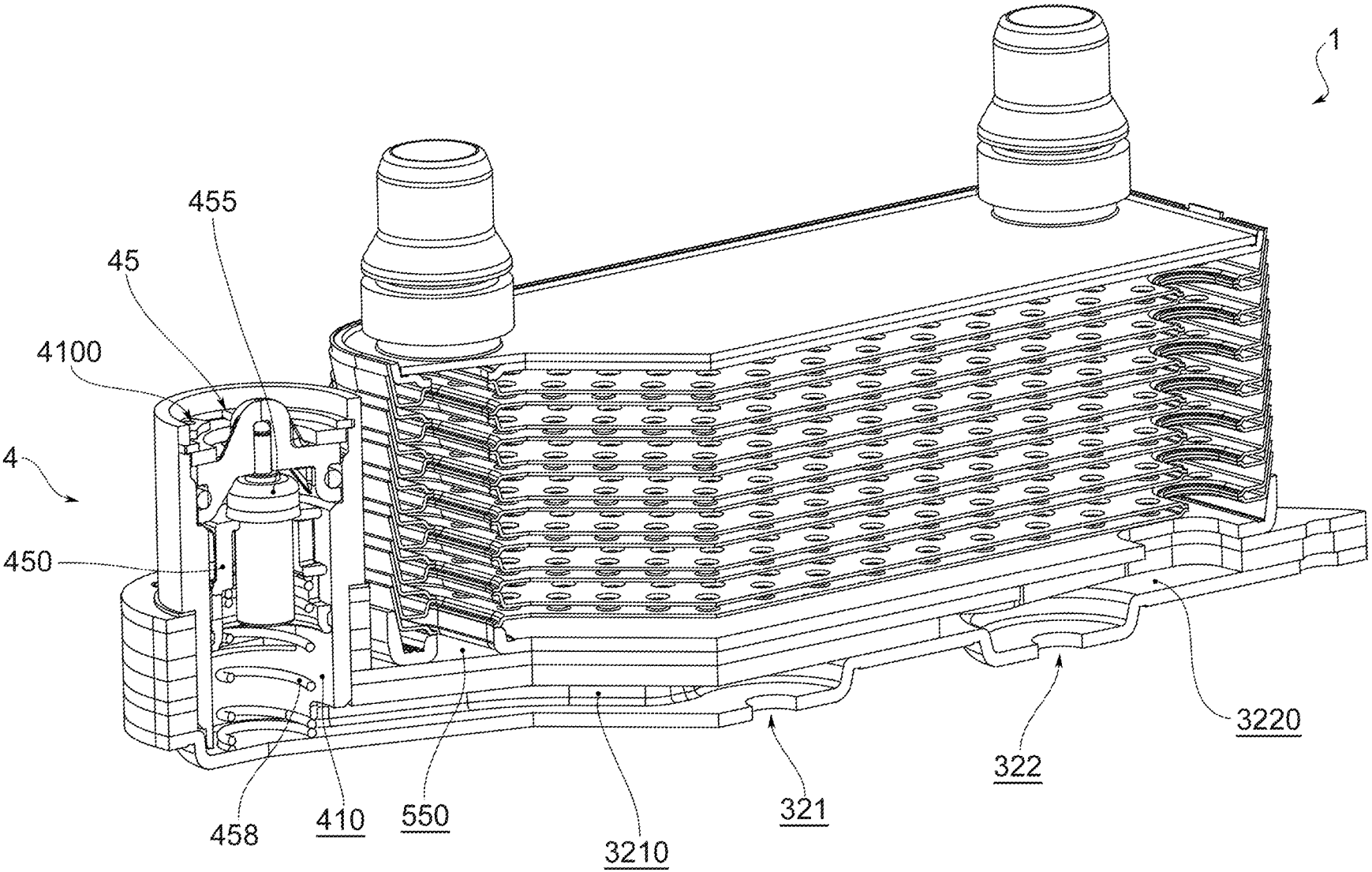
FIGS. 3', 3" and 3'" show three perspective views partially in cross-section, in which the ducts comprised in the oil temperature control assembly shown in FIG. 1 are shown in cross-section.
Figure 3:
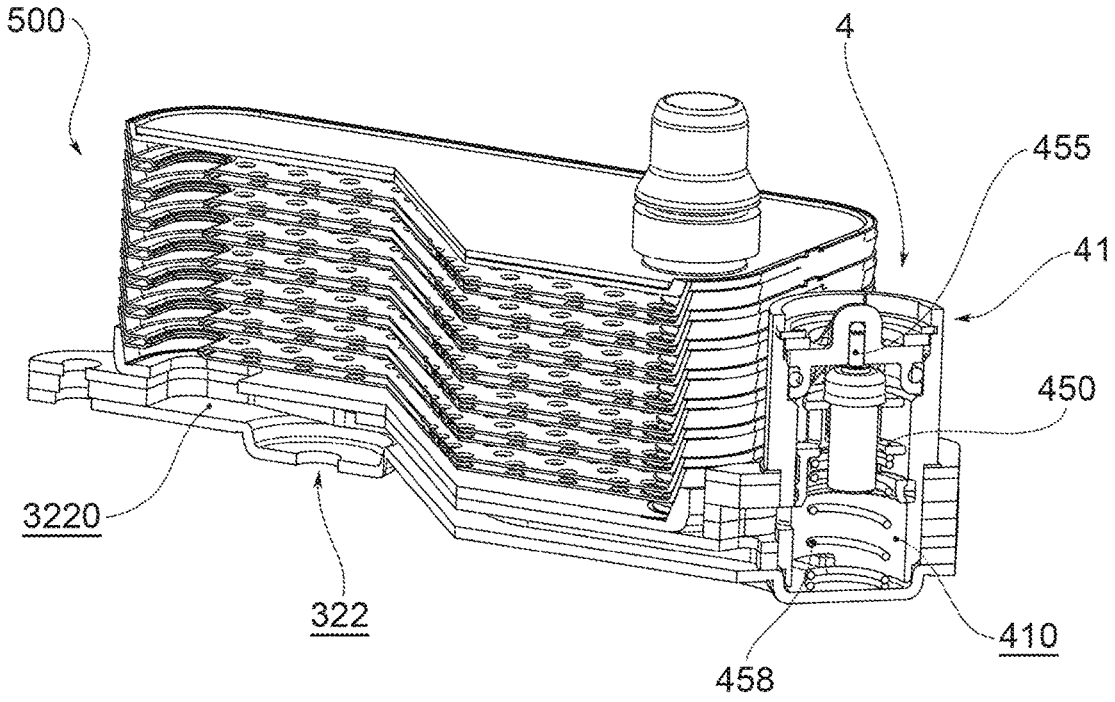
Figure 3:
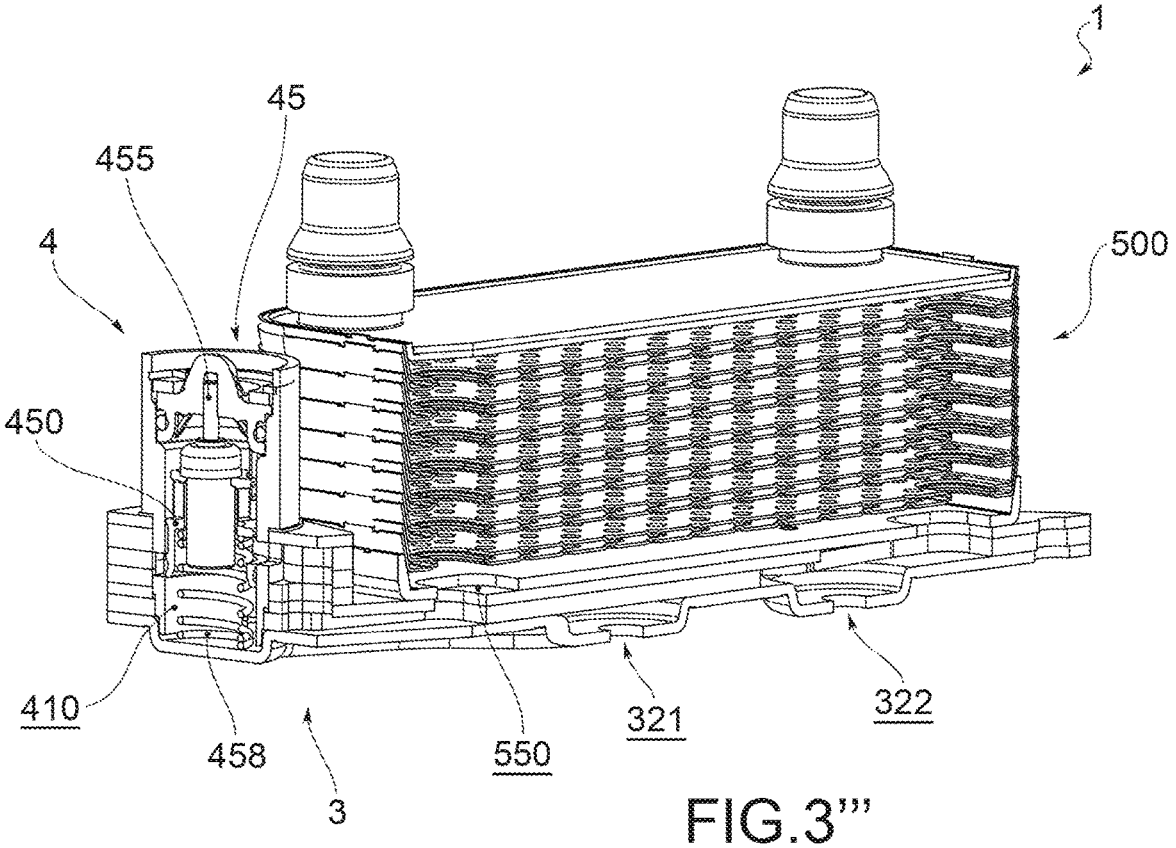
Figure 4A:
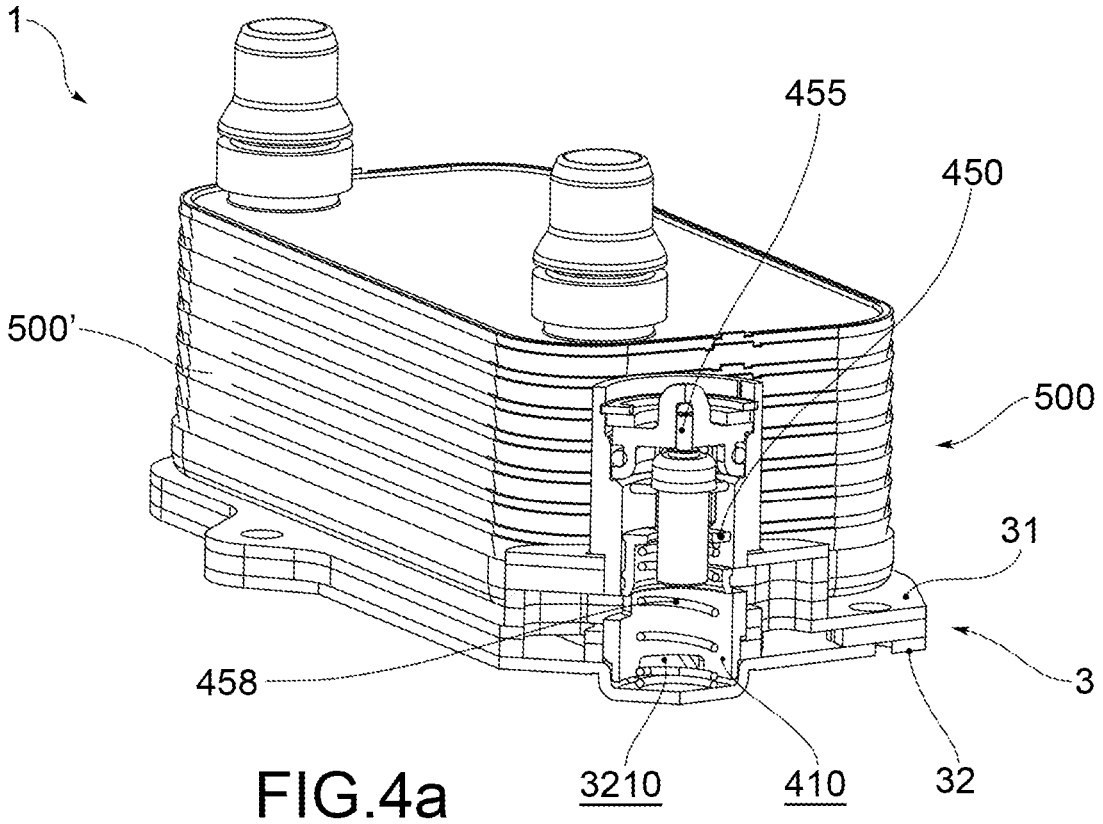
FIGS. 4*a* and 4*b* show two other perspective views in which the control assembly of the oil temperature control assembly shown in FIG. 1 is shown in cross-section, respectively in a bypass configuration and in an oil temperature control configuration.
Figure 4B:
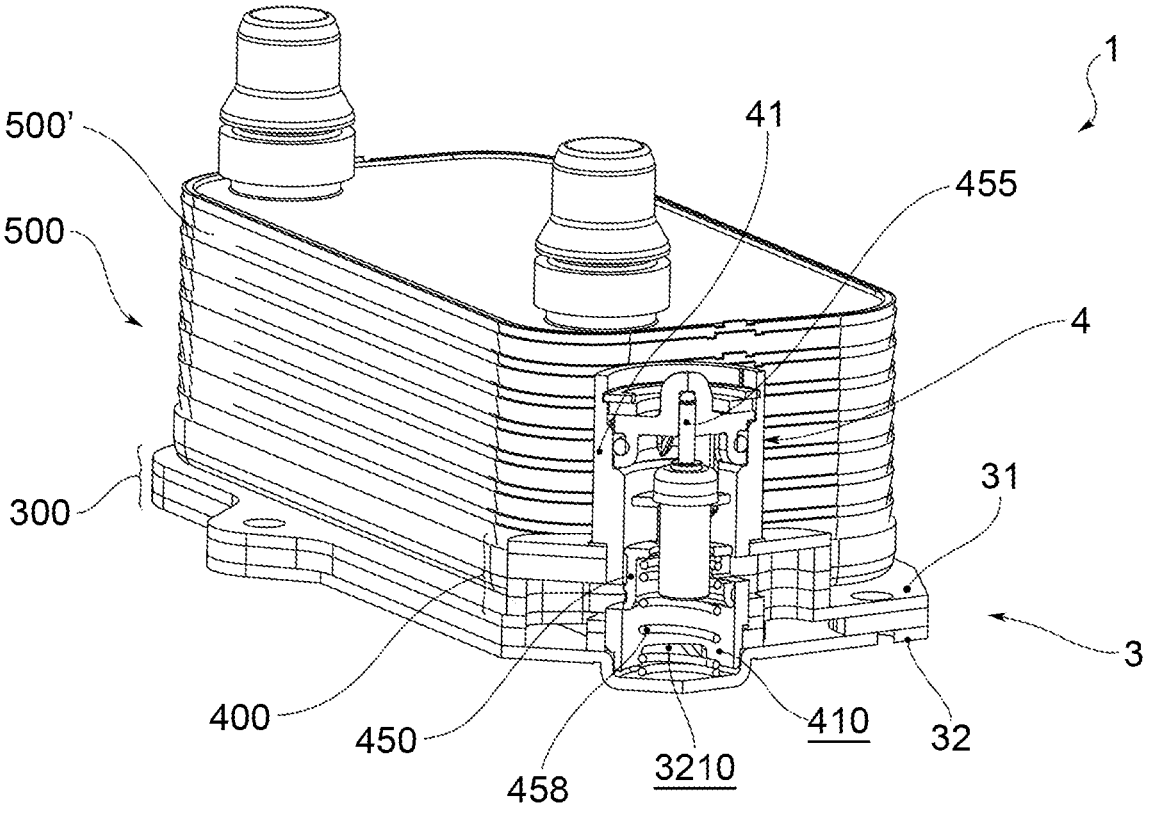
Figure 5:
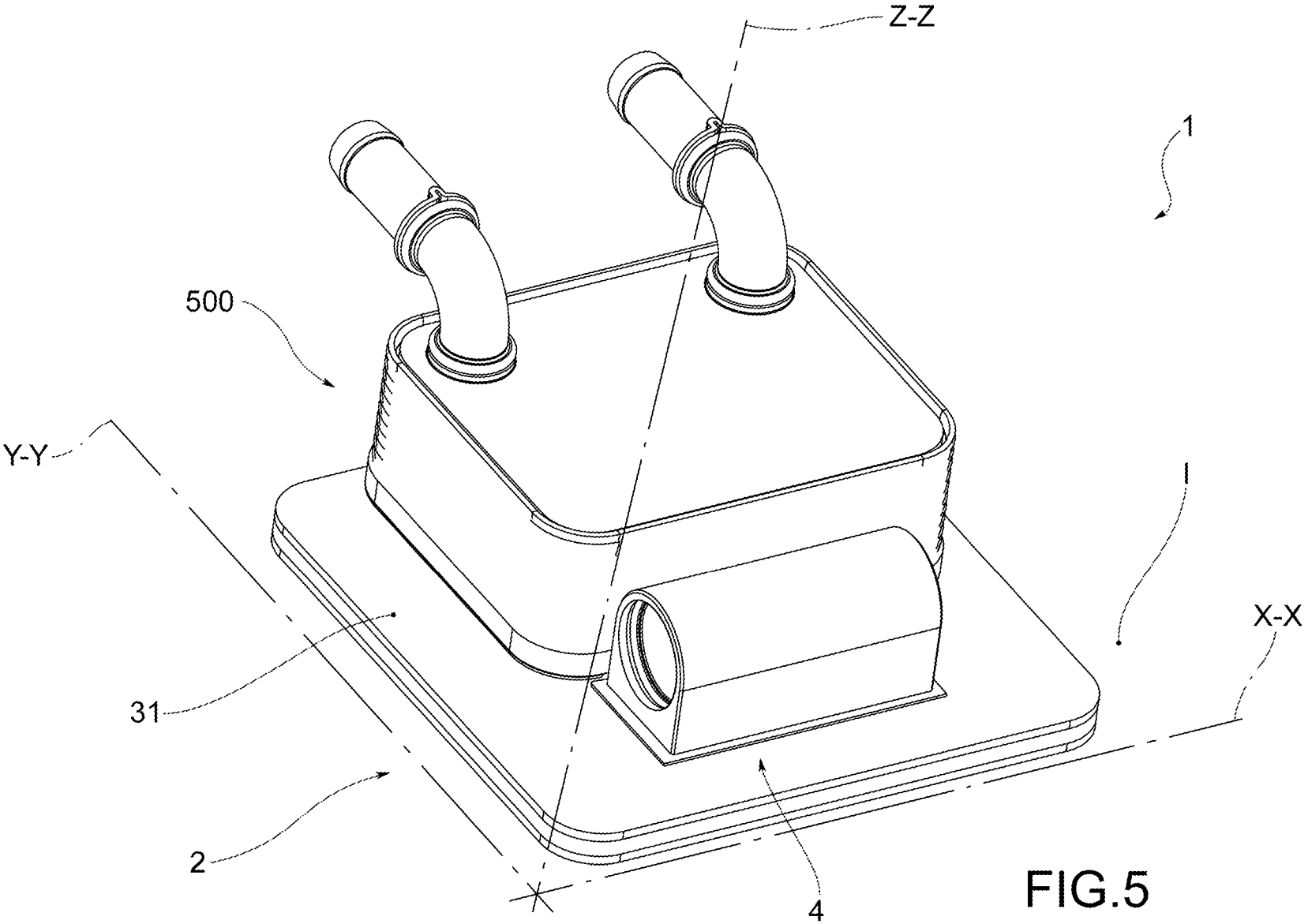
FIG. 5 shows a perspective view of the oil temperature control assembly of the present invention, according to a second preferred embodiment.
Figure 5B:
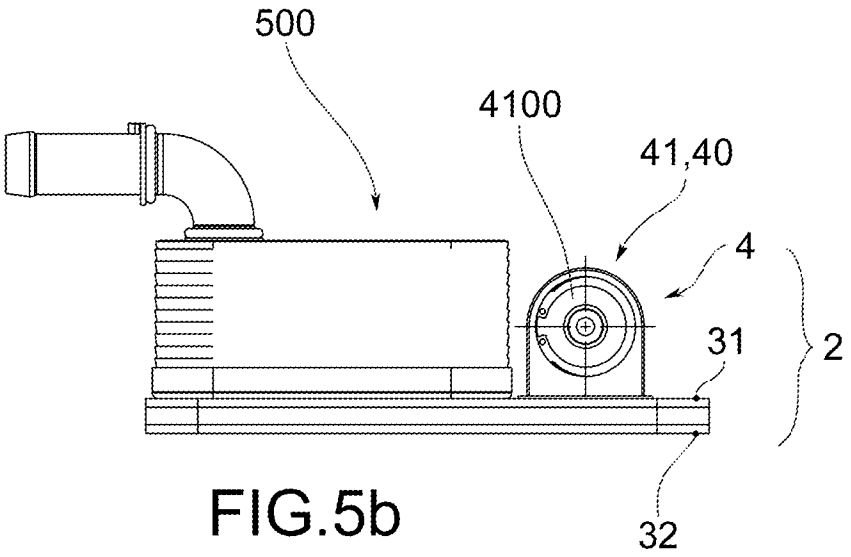
FIGS. 5*a*, 5*b* and 5*c* show three perspective views from the top, side, and bottom of the oil temperature control assembly shown in FIG. 5.
Figure 5A:
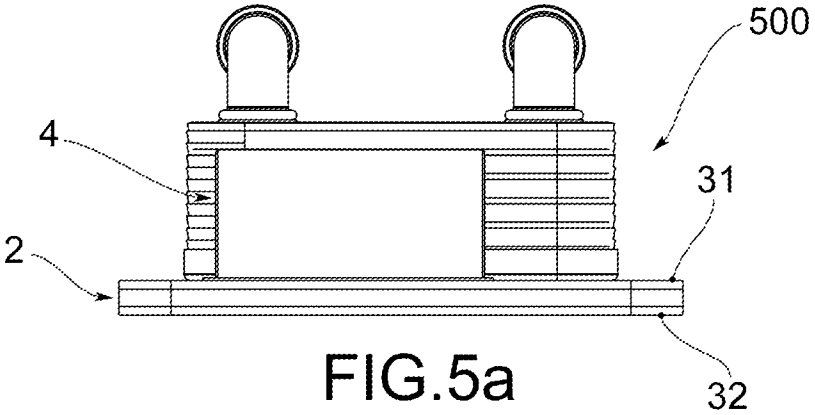
Figure 5C:
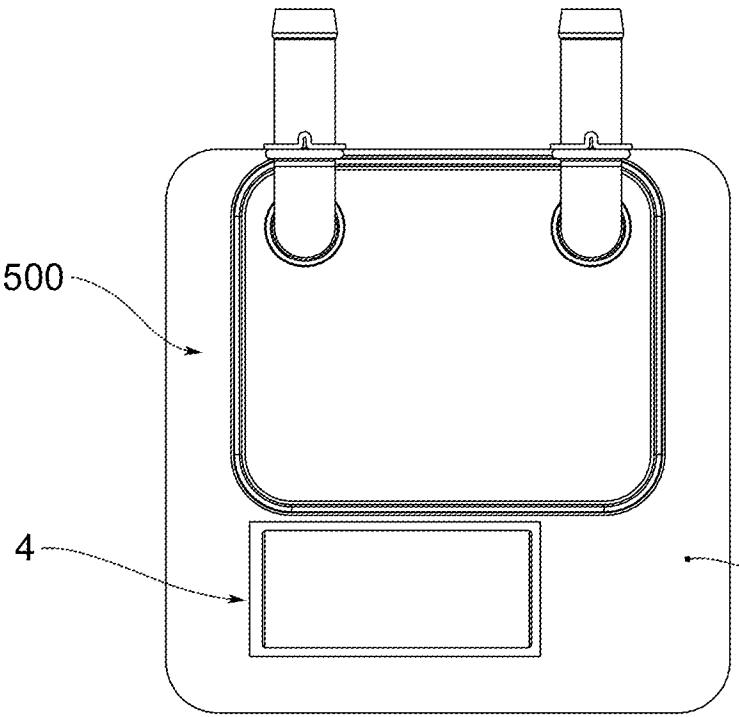
Figure 6B:
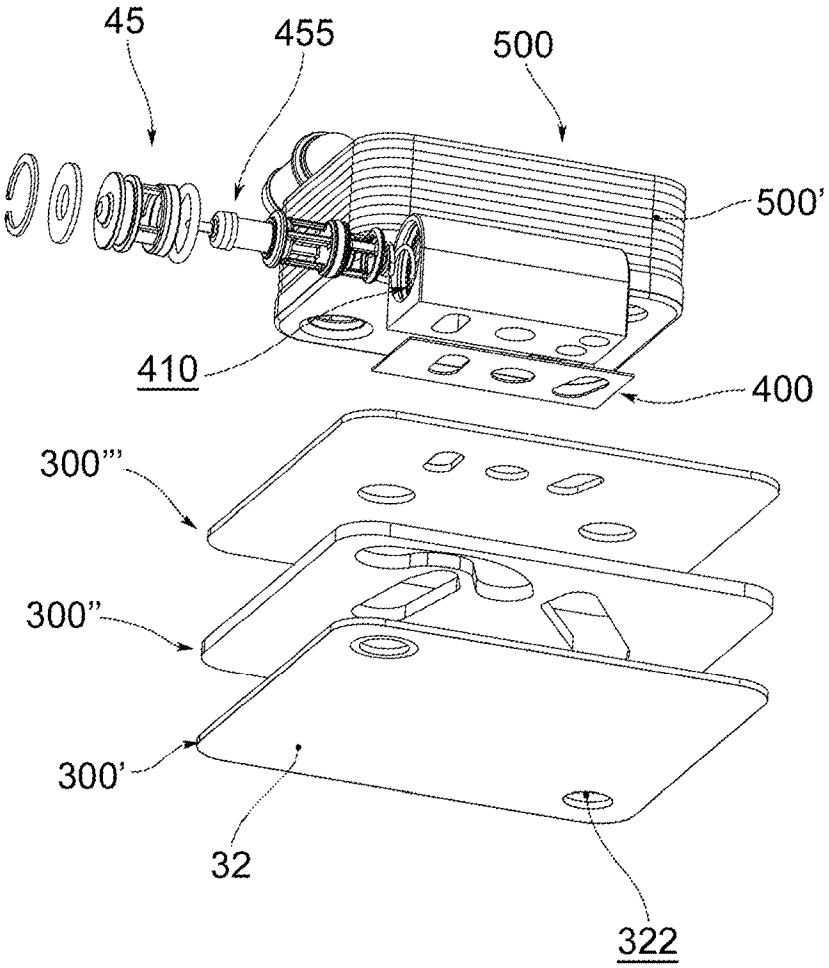
FIGS. 6*a* and 6*b* illustrate two perspective views in separate parts from the bottom and from the top of the oil temperature control assembly shown in FIG. 5.
Figure 6A:
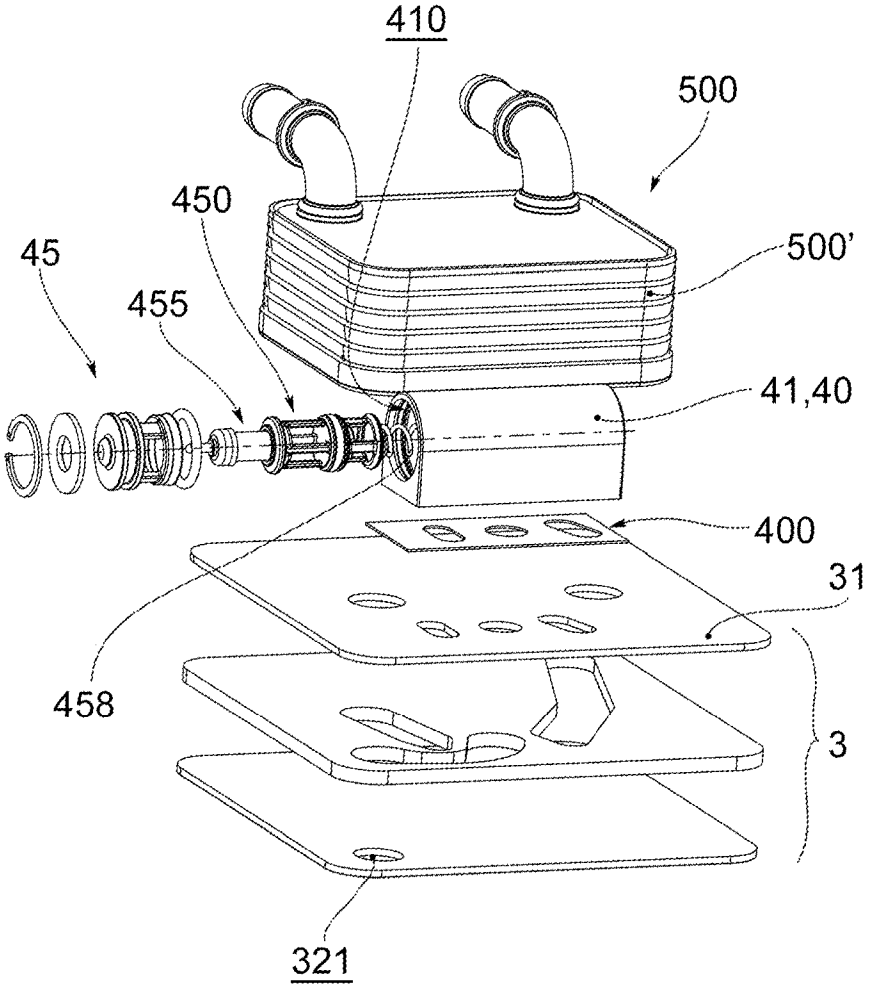
Figure 7:
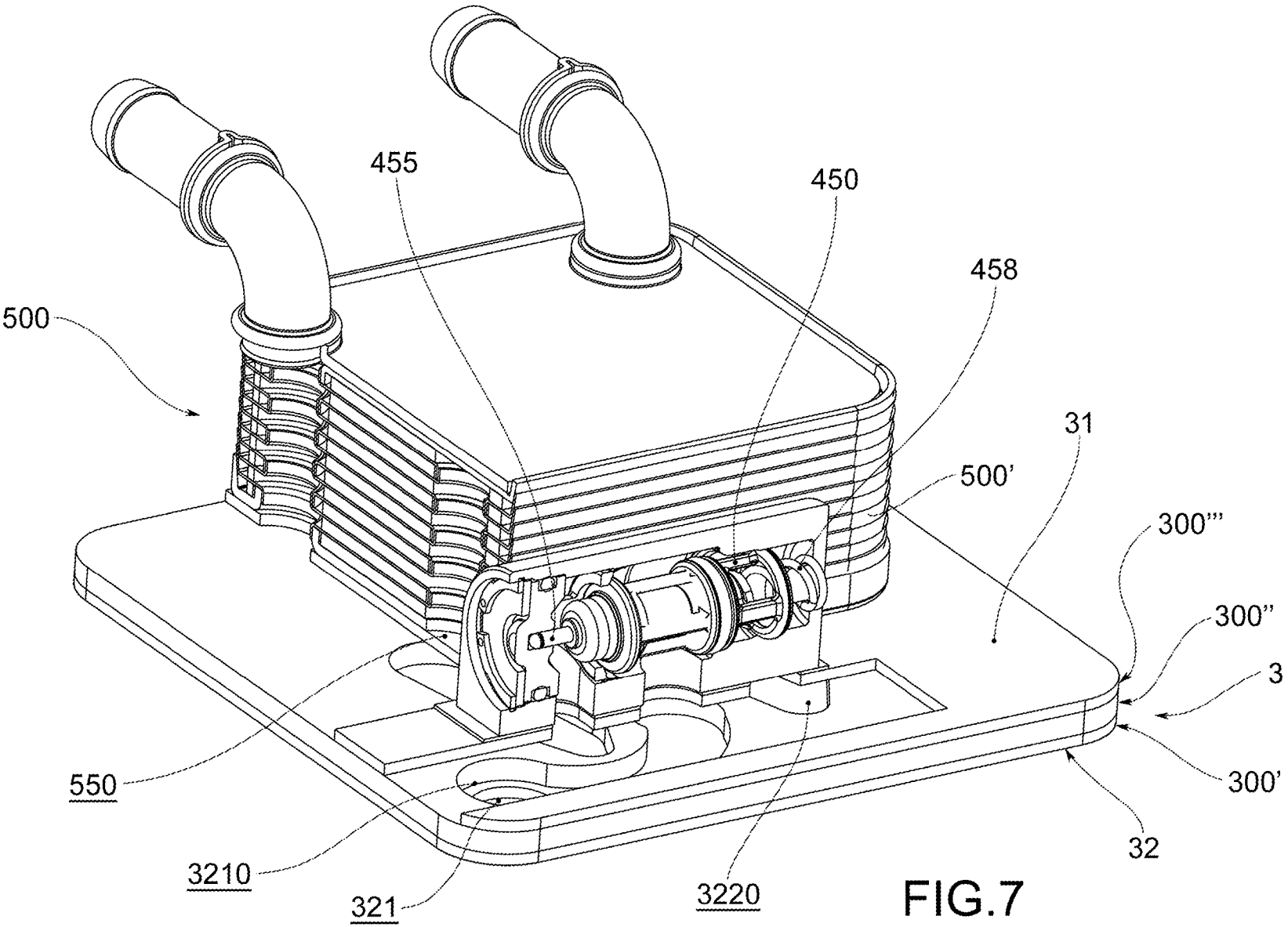
FIG. 7 shows a perspective view, partially in cross-section in which the ducts comprised in the oil temperature control assembly shown in FIG. 5, are shown in cross-section.
Figure 8A:
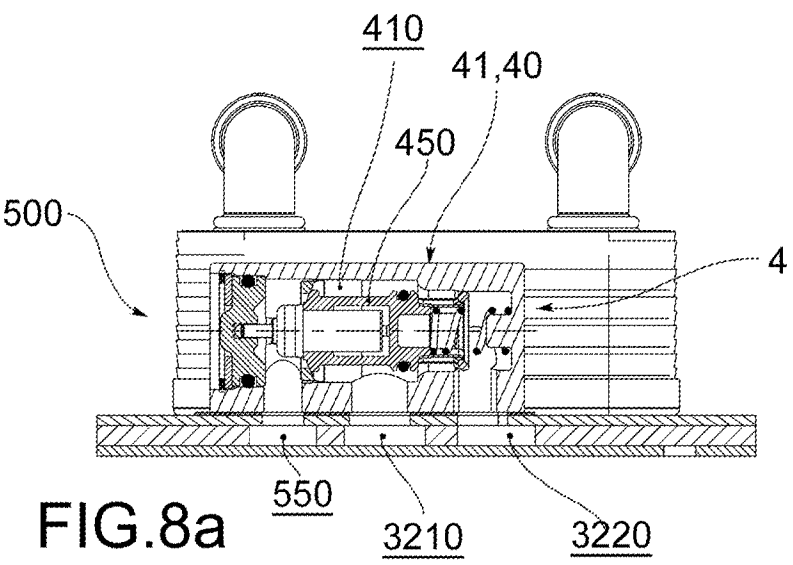
FIGS. 8*a*, 8*b*, 8*c* and 8*d* show four other cross-section views showing in cross-section the control assembly of the oil temperature control assembly shown in FIG. 5, respectively in a bypass configuration, in a first partial oil temperature control configuration, in a second partial oil temperature control configuration and in an oil temperature control configuration.
Figure 8B:
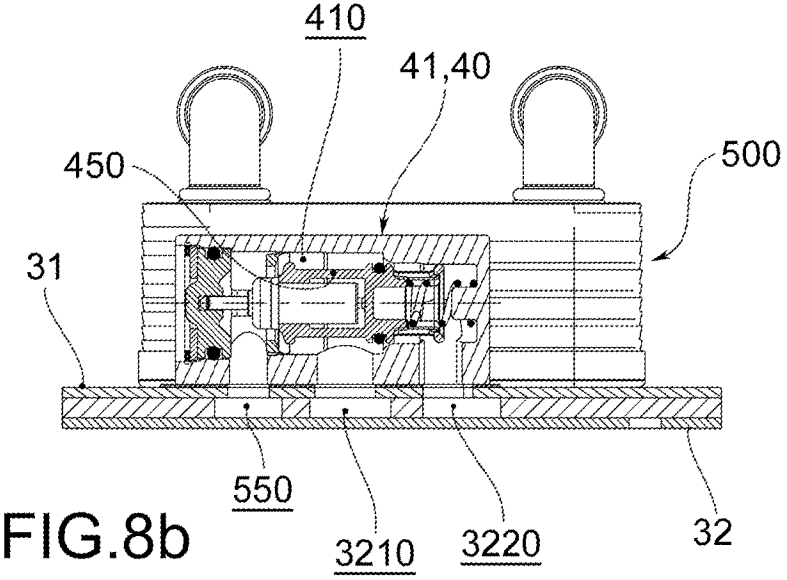
Figure 8C:
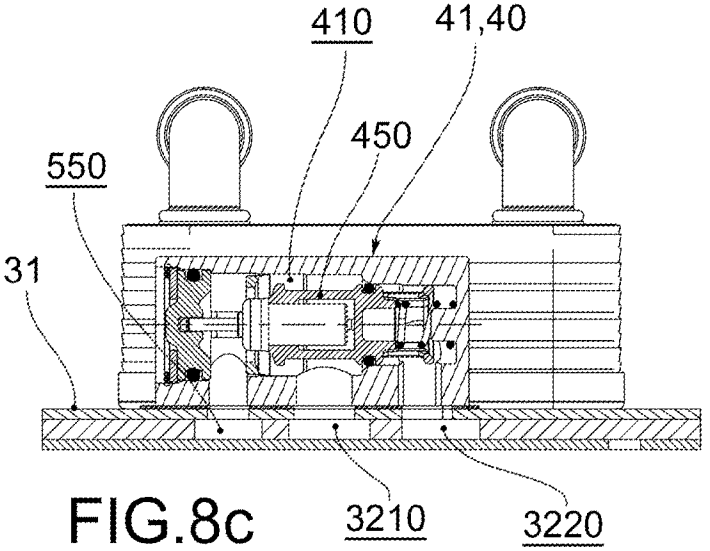
Figure 8D:
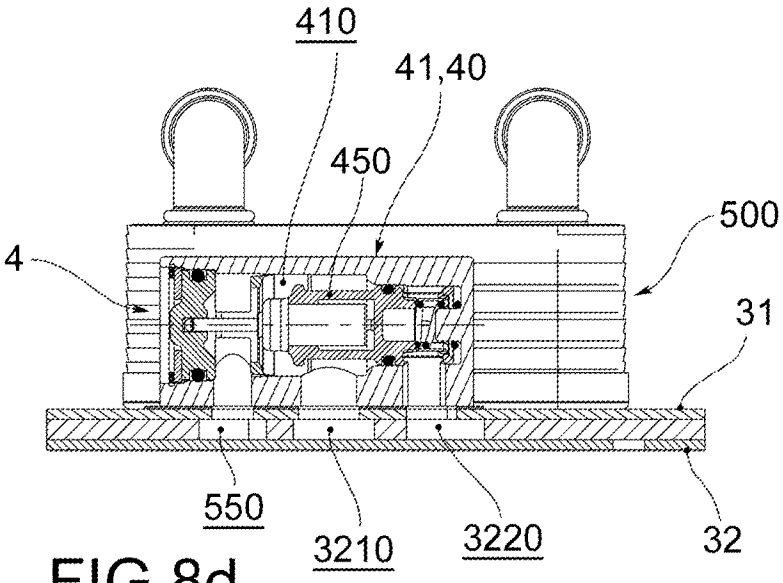

With reference to the appended drawings, reference numeral 1 denotes an oil temperature control assembly according to the present invention.

In particular, the control assembly of the present invention, as amply described below, is mountable on the operating group of a vehicle. Preferably, said operating group is an engine group, for example, internal combustion, or a transmission group.

According to the present invention, in fact, the oil temperature control assembly 1 of the present invention is fluidically connectable to an oil circulation system of said operating group and to a cooling system of said operating group or of said vehicle.

According to the present invention, moreover, as shown in a non-limiting manner in the appended drawings, the oil temperature control assembly 1 identifies a vertical axis Z-Z and two longitudinal axes X-X, Y-Y. In particular, the two longitudinal axes X-X, Y-Y lie on the same imaginary plane I which is orthogonal to the vertical axis Z-Z.

Preferably, in the description below, when reference is made to a planar position or elements this is meant with respect to said imaginary plane, and thus refers to components having substantially parallel extensions to the plane on which the longitudinal axes X-X, Y-Y lie. Similarly, in the description below, when reference is made to vertical overlaps, heights and extensions this refers to the direction parallel or coincident with the vertical axis Z-Z, therefore orthogonal to the longitudinal axes X-X, Y-Y.

According to the present invention, the oil temperature control assembly 1 comprises a heat exchanger 500. Preferably, the heat exchanger 500 is suitable to allow, as needed, a control of the oil temperature, for example of the engine oil. For example, as described below, the assembly 1 has special ducts suitable to allow the passage of oil and water to and from the operating group.

The heat exchanger 500 comprises a plurality of plate-shaped exchanger elements 500' overlapping along the vertical axis Z-Z defining ducts through which the oil or water flow.

Specifically, in fact, said plate-shaped exchanger elements 500' are specially shaped presenting special edges and walls which extend vertically orthogonally to the preferential planar extension. The overlapping of said plate-shaped exchanger elements 500' thus produces reciprocally alternating specific exchanger ducts in which oil flows and specific cooling ducts in which refrigerant liquid flows.

Preferably, the refrigerant inlet mouth and the refrigerant outlet mouth, through which the refrigerant liquid enters and exits, are made on a planar face. Preferably, said planar face is the face opposite that on which the heat exchanger 500 cooperates with a support and oil control device 2.

According to a preferred embodiment, the oil inlet and outlet are located on a face, preferably bottom, of the heat exchanger assembly 500, as described below and shown in the appended drawings. In particular, the inlet and outlet are fluidly connected to the operating assembly by means of a support and oil control device 2.

In particular, the oil temperature control assembly 1 of the present invention comprises, in addition to the heat exchanger 500 described above, a support and oil control device 2 engageable to the operating group of the vehicle. According to a preferred embodiment, the support and oil control device 2 is attachable directly to the operating group.

In other words, a first purpose of the support and oil control device 2 is to support the heat exchanger 500 and fluidically connect it to the operating group with the heat exchanger 500.

In addition, a second purpose of the support and oil control device 2 is to manage the control of the oil to the heat exchanger 500. In particular, the support and oil control device 2 operates to adjust the amount of oil directed to the exchanger either by inhibiting the passage of oil towards the heat exchanger 500, bypassing the heat exchanger 500 according to operating conditions, i.e. controlling the entire amount of oil in circulation in the oil system of the vehicle or operating group.

According to the present invention the support and oil control device 2 comprises a base element 3 substantially plate-shaped having a first surface 31 in contact and engageable by the heat exchanger 500 and a second surface 32 opposite the first.

Preferably, said second surface 32 is suitable to engage the operating group in a direct manner i.e. resting on it, or indirectly by resting on special clamping or support brackets.

According to the present invention, therefore an inlet mouth 321 for the input of the oil to the heat exchanger 500, and an outlet mouth 322 for the output of the oil to the operating group are made on said base element 3. In particular, the inlet mouth 321 and the outlet mouth 322 are positioned on said second surface 32.

According to the present invention, inlet 3210 and outlet 3220 ducts are made on said base element 3 which extend from said inlet 321 and outlet 322 mouths to the exchanger 500 and vice versa.

According to a preferred embodiment, the base element 3 comprises a plurality of plate-shaped elements 300', 300", 300''' overlapping along the vertical Z-Z axis mutually shaped to define in stacking the inlet 3210 and outlet 3220 ducts extending from said inlet 321 and outlet 322 mouths to the exchanger 500 and vice versa. In other words, the axial stacking of the base plate-shaped elements and in particular the overlapping of through openings on said plate-shaped elements defines the aforesaid ducts.

According to a preferred embodiment, the plate-shaped base elements 300', 300', 300''' are at least three in number which in their vertical stacking define said ducts.

According to a preferred embodiment, the plate-shaped element on which the heat exchanger rests is completely planar.

According to a preferred embodiment, the two base plate-shaped elements are both completely planar. By way of example, the second preferred embodiment shown in the drawings has such characteristic.

According, instead, to the first preferred embodiment shown in the drawings, the base plate-shaped element 300' which has said second surface 32 on which the inlet and outlet mouths are made, has at least one protruding portion, preferably two protruding portions, inside which a portion of said inlet 3210 and outlet 3220 ducts extend.

In other words, said base plate-shaped element is shaped to present specific protrusions to define an increased through section of the respective ducts.

In one embodiment variation, said increased section ducts is also obtainable by stacking a plurality of base plate-shaped elements.

According to a preferred embodiment, said base plate-shaped elements are made of metal, preferably of aluminium alloy or other alloys that are workable by the brazing process.

According to a preferred embodiment, the support and oil temperature control device 2 comprises a control assembly 4. Preferably said control assembly 4 is positioned on the base element 3 and is fluidly connected to it and the heat exchanger 500.

In particular the control assembly 4 comprises a housing body 41 projecting in height from the first surface 31 along the Z-Z axis next to the heat exchanger 500.

In said housing body 41 there is a housing cavity 410 fluidically connected to said inlet mouth 321 and said outlet mouth 322 and to an exchanger duct 550.

In addition, the control assembly 4 comprises a valve member 45 housed in said housing cavity 410 suitable to control the oil flow in input to the outlet mouth and/or to the exchanger duct.

Said valve member 45 comprises an obturator element 450 and a control element 455 which moves the obturator element 450 according to the operating conditions of the oil flowing inside said cavity 410.

According to a preferred embodiment, the control element 455 is of the temperature-sensitive type and moves the obturator element 450 according to the temperature of the oil flowing inside said cavity 410.

According to an embodiment variant, the control element 455 is of the pressure-sensitive type and moves the obturator element 450 according to the pressure of the oil flowing inside said cavity 410.

Preferably, depending on the position of the obturator element 450 (controlled by the control element 455) the oil flow in input to the outlet mouth and/or to the exchanger duct is controlled.

According to a preferred embodiment, the control assembly 4, and in particular the housing body 41, has a main vertical extension extending parallel to the vertical axis Z-Z (as shown by way of example in FIGS. 1 to 4).

According to a preferred embodiment, the control assembly 4, and in particular, the housing body 41, has a main horizontal extension, extending parallel to the imaginary plane I, preferably parallel to the longitudinal axis X-X (as shown by way of example in FIGS. 5 to 8).

There are also mixed solutions providing for the control assembly 4 protruding from the first surface 31 both vertically and horizontally.

According to a preferred embodiment, the housing cavity 410 is in a fluidic position between the inlet mouth 321 and the heat exchanger 500 to receive the oil in input and control the transit thereof to the outlet mouth 322 and/or the exchanger duct 550.

According to a preferred embodiment, the housing body 41 defines specific fluidic connection portions with the inlet duct 3210, the outlet duct 3220 and exchanger duct 550 having on the wall defining the housing cavity 410 respective openings.

In other words, in the housing body 41 the fluidic connections are recreated placing in communication the ducts of the base element 3 and the heat exchanger 500. In particular, according to the embodiments shown in the drawings, said fluidic connections are clearly visible in the figures showing the control assembly 4 in cross-section or in separate parts.

According to a preferred embodiment, the housing body 41 at least in part comprises a plurality of body plate-shaped elements 400 overlapping along the vertical axis Z-Z specially shaped in such a way that in the reciprocal overlapping they define said fluidic connection portions and the respective openings on the respective wall portion defining the housing cavity 410. In other words, the axial stacking of the body plate-shaped elements and in particular the overlapping of respective through openings on said plate-shaped elements defines the aforesaid fluidic connections or said fluidic connection portions.

According to a preferred embodiment, said body plate-shaped elements are made of metal, preferably they are made of aluminium alloy or other alloys which are workable in a brazing process.

According to a preferred embodiment, the housing body 41 comprises a housing cylinder 40 inside which the valve member 45 is housed and operates.

Such housing cylinder 40 defines at least partially said housing cavity 410 and/or said fluidic connection portions and/or respective openings. In other words, the housing cylinder 40 and/or the body plate-shaped elements 400 define the housing cavity 410 and are fluidically mutually connected with the other ducts.

According to a preferred embodiment, the obturator element 45 is inserted as a cartridge inside the housing body 41.

For example, the obturator element 45 is cartridge inserted inside the housing body 41 which has a specific insertion opening 4100 capped by a respective sealing cap.

According to a preferred embodiment, the obturator element 450 is movable in an axial direction by the control element 455.

According to a preferred embodiment, the obturator element 450 is adjustable in a rotary direction by the control element 455.

According to a preferred embodiment, the control element 455 is of the heat-sensitive type comprising a wax element able to move the obturator element 450 depending on the oil temperature.

According to a preferred embodiment, the control element 455 is of the heat-sensitive type comprising an element in a shape memory material. For example, an axial or torsion helical spring.

According to a preferred embodiment, the valve member 45 also comprises a return element 458 suitable to perform an action counter to that of the control element. Preferably said return element 458 is a spring.

According to an embodiment variant, the return element 458 is in turn a heat-sensitive element suitable to vary its action according to the oil temperature in the housing cavities 410.

According to a preferred embodiment, the return element 458 engages on one side the obturator element 455 and on the other the housing body 41. In other words, according to a preferred embodiment, the return element 458 does not engage the base element 3. This is clearly visible in the second preferred version shown in the appended drawings. However, it is also easily implementable on the first version, for example by providing special abutments for the return element 458 by means of at least one body plate-shaped element 400.

Figure 9:
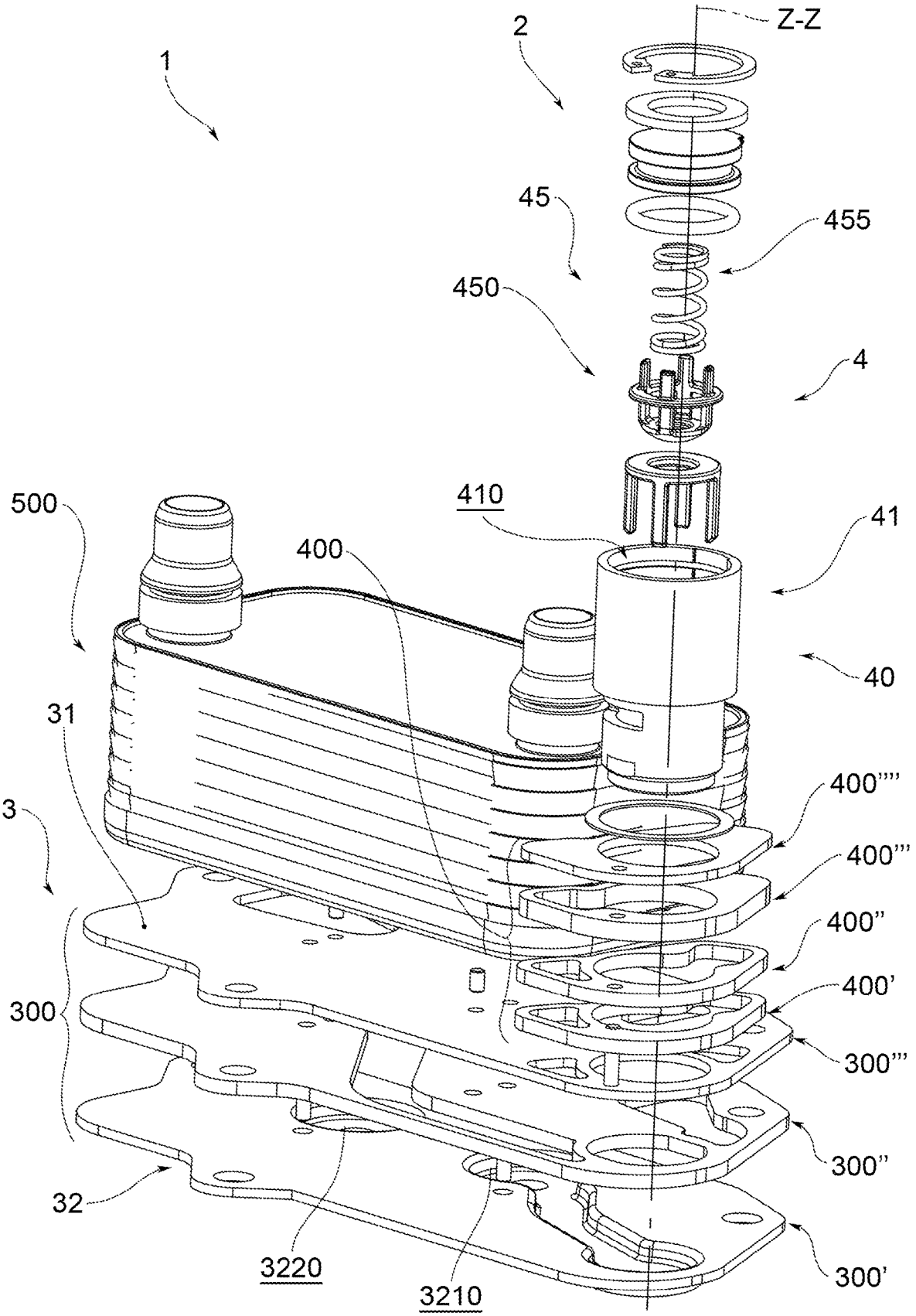
FIG. 9 shows a perspective view in separate parts of the oil temperature control assembly according to the present invention, in an embodiment with a pressure-sensitive type control element.
Figure 10A:
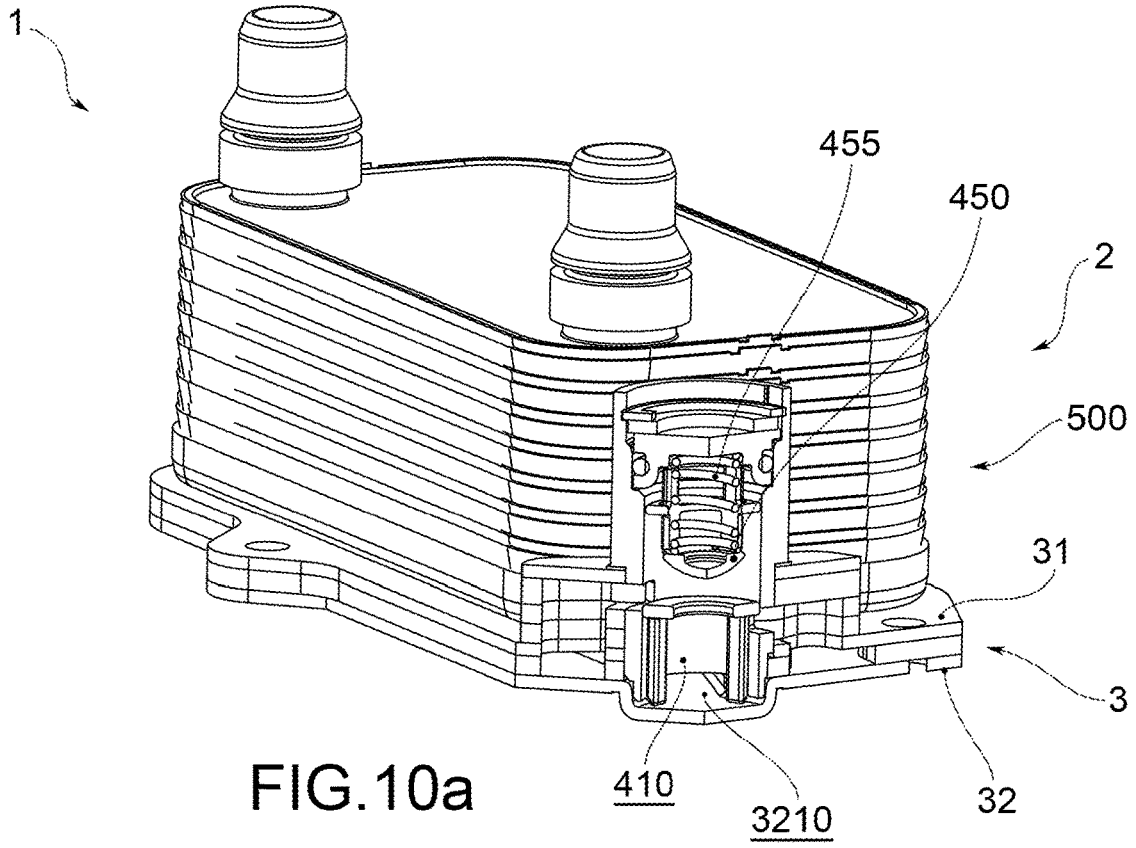
FIGS. 10*a* and 10*b* show two perspective views showing in cross-section the control assembly of the oil temperature control assembly shown in FIG. 1, respectively in a bypass configuration and an oil temperature control configuration.
Figure 10B:
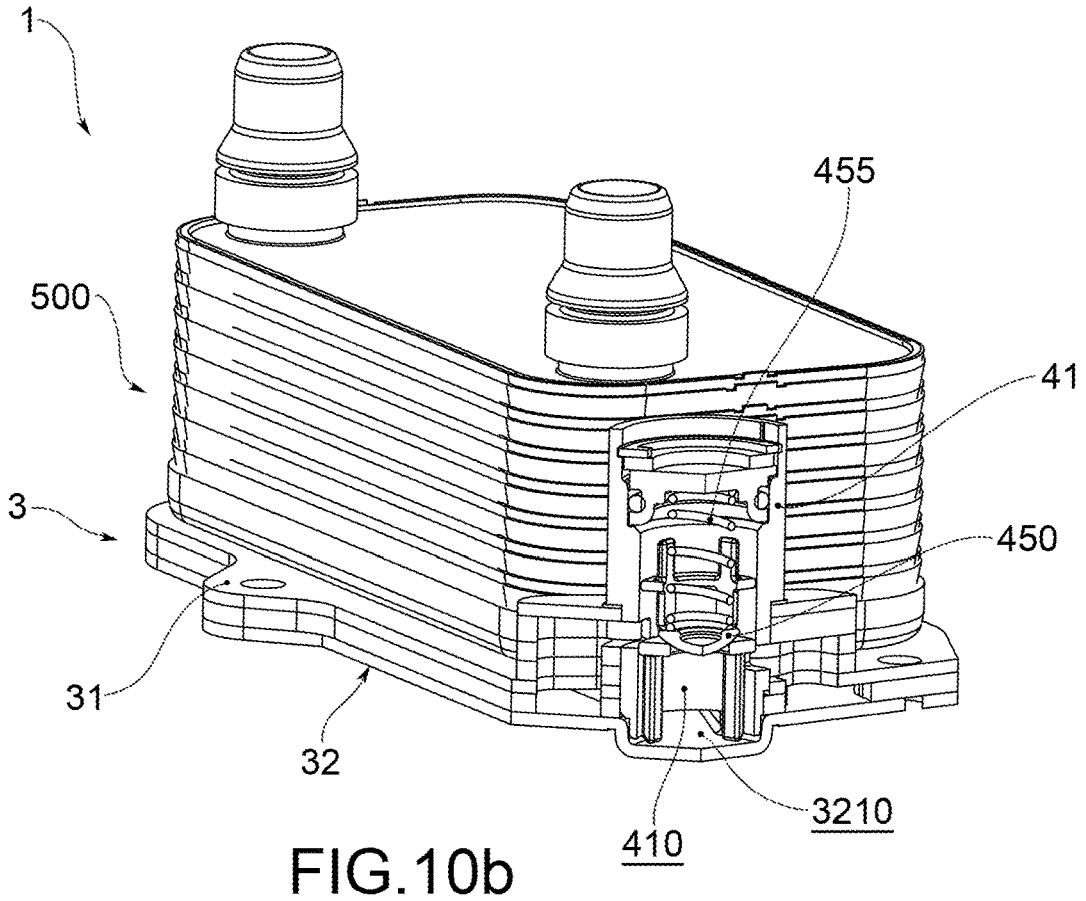

According to a preferred embodiment, the control element 450 of the pressure-sensitive type is an elastically yielding element acting in the axial direction (e.g. helical spring) able to move the obturator element 450 along the valve axis according to the pressure difference between the inlet side and the outlet side. According to a preferred embodiment, the control element is configured to determine a displacement of the obturator element depending on pressure differences varying from 0.5 to 5 bar. An embodiment of this type is shown by way of example in FIGS. 9, 10*a* and 10*b*

According to some embodiment variants, the control element 450 is both of the heat-sensitive and pressure-sensitive type, for example being a helical spring in a shape memory material.

According to a preferred embodiment, the obturator element 450 has a substantially cylindrical shape. In other words, the obturator element 450 engages the walls of the housing cavity 410 presenting closure partitions and through holes which, depending on their respective axial (or possibly angular) position, allow, regulate or prevent the flow of oil.

According to the present invention, as shown for example in the attached drawings, the control assembly 4 is in fact suitable to be configured in a bypass configuration in which the oil does not flow to the exchanger 500 but is directed straight to the outlet mouth 322 and in an oil temperature control configuration in which the oil flows entirely into the heat exchanger 500.

According to some embodiment variants, the control assembly 4 is in fact suitable to be configured in a first partial oil temperature control configuration in which a part of oil (typically a small part) flows toward the heat exchanger 500 while the other part (greater) flows toward the outlet mouth 322.

According to some embodiment variants, the control assembly 4 is in fact suitable to be configured in a second partial oil temperature control configuration in which a part of oil (typically a greater part) flows toward the heat exchanger 500 while the other (lesser) flows toward the outlet mouth 322.

According to a preferred embodiment, the plate-shaped elements 550 of the heat exchanger assembly 500 are mutually integrally joinable with a brazing operation, preferably in autoclave.

According to a preferred embodiment, the base plate-shaped elements 300 of the base element 3 are mutually integrally joinable with a brazing operation, preferably in autoclave.

According to a preferred embodiment, the body plate-shaped elements 400 of the housing body 41 are mutually integrally joinable with a brazing operation, preferably in autoclave.

Preferably, the body plate-shaped elements 400 and the base plate-shaped elements 300 are mutually integrally joinable with a brazing operation.

Preferably, the body plate-shaped elements 400 and/or the base plate-shaped elements 300 and the plate-shaped elements 550 are mutually integrally joinable with a brazing operation.

Innovatively, the oil temperature control assembly fully absolves the purpose of the present invention overcoming the drawbacks typical of the prior art.

Advantageously, in fact, the oil temperature control assembly has a particularly simple layout despite being of the "adjustable" type in its fluidic connection with the respective operating group.

Advantageously, the positioning of the control unit allows simple and intuitive maintenance and replacement operations for example of the valve member.

Advantageously, high accessibility to the control assembly is ensured.

Advantageously, the oil temperature control assembly has the operating components (exchanger and valve) on the same side, simplifying the surface configuration suitable for fluidic coupling with the operating group.

Advantageously, the temperature control assembly is suitable to be combined with temperature or pressure-sensitive control elements without requiring any substantial modification of the assembly layout, and in particular neither of the base element or of the heat exchanger.

Advantageously, a planar or as planar as possible mounting surface to the operating group is guaranteed.

Advantageously, the base element is designed as needed (e.g. to the necessary sizes—cross-sections—of the ducts), in particular the respective plate-shaped elements that compose it are designed as needed so as to prove extremely flexible.

Advantageously, the housing body is designable as needed (for example, to the necessary sizes—in cross-section—of the ducts): in particular the respective body plate-shaped elements and/or housing cylinder that compose it are designed as needed so as to prove extremely flexible.

Advantageously, the oil temperature control assembly ensures high maximisation of the use of space in the vehicle. Advantageously, the oil temperature control assembly is particularly flexible in its application, e.g. allowing the designer to fully exploit the free space in the vehicle.

It is clear that a person skilled in the art may make modifications to the oil temperature control assembly described above so as to satisfy contingent requirements, all contained within the scope of protection as defined by the following claims.

LIST OF REFERENCE NUMBERS

1 oil temperature control assembly
2 support and oil control device
3 base element
31 first surface
32 second surface
321 inlet mouth
3210 inlet duct
322 outlet mouth
3220 outlet duct
300, 300', 300", 300'" base plate-shaped elements
4 control assembly
40 housing cylinder
400, 400', 400", 400'", 400"" body plate-shaped elements
41 housing body
410 housing cavity
45 valve member
450 obturator element
455 control element
4100 insertion opening
500 heat exchanger
500' exchanger plate-shaped elements
550 exchanger duct
X-X, Y-Y longitudinal axes
Z-Z vertical axis
I imaginary plane

The invention claimed is:

1. Oil temperature control assembly fluidically connectable to an oil circulation system of an operating group of a vehicle, and to a cooling system of said operating group or of said vehicle, wherein the oil temperature control assembly identifies a vertical axis and two longitudinal axes lying mutually orthogonal to each other on a same main imaginary plane orthogonal to said vertical axis, wherein said assembly comprises:

a) a heat exchanger comprising a plurality of plate-like exchanger elements superposed along the vertical axis to define mutually alternated ducts through which oil and cooling liquid flow;

b) an oil control and support device comprising:

a base element substantially plate-shaped presenting a first surface in contact and engageable by the heat exchanger and a second surface opposite the first surface, wherein on said second surface are made an inlet mouth of the oil towards the heat exchanger, and an outlet mouth of the oil towards the operating group, wherein in said base element, inlet and outlet ducts extend from said inlet and outlet mouths to and from the heat exchanger and vice versa;

a control assembly positioned on the base element and fluidically connected to the base element, the control assembly being in fluidic communication with the heat exchanger solely through the base element, the control assembly comprising:

i) a housing body projecting in height starting from the first surface along the vertical axis beside the heat exchanger and external to the heat exchanger in which said housing body has a housing cavity fluidically connected to said inlet mouth and to said outlet mouth and to an exchanger duct;

ii) a valve member housed in said housing cavity comprising an obturator element and a heat-sensitive or pressure-sensitive control element, which moves the obturator element according to operating conditions of the oil flowing inside said cavity wherein depending on a position of the obturator element, flow of oil in input to the outlet mouth and/or towards the exchanger duct is controlled.

2. Oil temperature control assembly according to claim 1, wherein the base element comprises a plurality of base plate-shaped elements, two of the base plate-shaped elements superposed along the vertical axis mutually shaped to define in stacking the inlet duct and the outlet duct extending starting from said inlet and outlet mouths to the exchanger and vice versa.

3. Oil temperature control assembly according to claim 2, wherein the base element on a base plate-shaped element has said second surface, wherein said base plate-shaped element is specially shaped, having at least one protruding portion, inside which a portion of said inlet and outlet ducts extend.

4. Oil temperature control assembly according to claim 1, wherein the housing body has a main vertical extension extending parallel to the vertical axis.

5. Oil temperature control assembly according to claim 1, wherein the housing body has a main horizontal extension, extending parallel to the imaginary plane.

6. Oil temperature control assembly according to claim 1, wherein the housing cavity is in a fluidic position between the inlet mouth and the heat exchanger to receive the oil in input and control passage of the oil to the outlet mouth and/or the exchanger duct, wherein the housing body defines fluidic connection portions with the inlet duct the outlet duct and the exchanger duct has, on a wall portion defining the housing cavity, respective openings.

7. Oil temperature control assembly according to claim 6, wherein the housing body comprises a plurality of body plate-shaped elements superposed along the vertical axis, each of the plurality of plate-shaped elements having a main plane transverse to the vertical axis shaped so that in reciprocal superimposition the body plate-shaped elements define said fluidic connection portions and the respective openings on the respective wall portion defining the housing cavity.

8. Oil temperature control assembly according to claim 1, wherein the housing body comprises a housing cylinder inside which the valve member is located and operates.

9. Oil temperature control assembly according to claim 8, wherein the housing cylinder defines at least partially said housing cavity and/or said fluidic connection portions and/or respective openings.

10. Oil temperature control assembly according to claim 1, wherein the obturator element is movable in a rotary direction by the control element.

11. Oil temperature control assembly according to claim 1, wherein the control element is heat-sensitive and moves the obturator element according to temperature of the oil flowing inside said cavity, wherein the heat-sensitive element is a wax element or is an element in a shape memory material.

12. Oil temperature control assembly according to claim 1, wherein the control element is pressure-sensitive and moves the obturator element according to pressure of the oil flowing inside said housing cavity.

13. Oil temperature control assembly according to claim 12, wherein the obturator element has a substantially cylindrical shape with a first end nearer the base plate being closed, wherein the return element engages the obturator element on the first end and the housing body on a second end.

14. Oil temperature control assembly according to claim 1, wherein the valve member comprises a return element to perform an opposite action to an action of the control element.

15. Oil temperature control assembly according to claim 14, wherein the return element is a heat-sensitive element to vary action of the return element according to temperature of the oil in the housing cavity.

16. Oil temperature control assembly according to claim 1, wherein the obturator element has a substantially cylindrical shape, to engage the walls of the housing cavity presenting closing partitions and through holes which, depending on axial or angular position allow, control or prevent the flow of oil.

17. Oil temperature control assembly according to claim 1, wherein the plate-shaped elements of the heat exchanger group and/or of the base element and/or of the control assembly are mutually integrally joinable by brazing.

18. Oil temperature control assembly according to claim 1, wherein the housing body has a main horizontal extension parallel to the longitudinal axis.

19. Oil temperature control assembly according to claim 1, wherein the obturator element has a substantially cylindrical shape with an end nearer the base plate being closed, to engage the walls of the housing cavity presenting closing partitions and through holes which, depending on axial or angular position allow, control or prevent the flow of oil.

20. Oil temperature control assembly according to claim 1, wherein the obturator element has a substantially cylindrical shape with a closed first end and a closed second end to engage the walls of the housing cavity to cover and uncover closing partitions and through holes which, depending on axial or angular position allow, control or prevent the flow of oil.

* * * * *